United States Patent [19]

Marinelli et al.

[11] Patent Number: 4,740,495

[45] Date of Patent: Apr. 26, 1988

[54] PROTECTIVE COATING FOR THERMOSENSITIVE MATERIAL

[75] Inventors: Nicola Marinelli; Maurice W. Lewis, both of Dayton; Stephen D. Lakes, Carrollton; Paul W. Seitz, Miamisburg, all of Ohio

[73] Assignee: NCR Corporation, Dayton, Ohio

[21] Appl. No.: 724,379

[22] Filed: Apr. 18, 1985

[51] Int. Cl.[4] ..... B41M 5/18

[52] U.S. Cl. ..... 503/214; 106/21; 106/31; 427/150; 427/151; 427/152; 503/200; 503/225; 503/226

[58] Field of Search ..... 346/200, 226, 208, 209; 427/150, 151, 152; 428/913, 914, 484, 488.1, 488.4; 106/14.5, 21, 31; 503/200, 208, 209, 214, 226, 225

[56] References Cited

U.S. PATENT DOCUMENTS

| | | | |
|---|---|---|---|
| 3,516,904 | 6/1970 | Klinker, Jr. | 161/227 |
| 4,286,017 | 8/1981 | Nakamura et al. | 427/151 |
| 4,321,309 | 3/1982 | Mino et al. | 427/151 |
| 4,370,370 | 1/1983 | Iwata et al. | 428/40 |
| 4,388,362 | 6/1983 | Iwata et al. | 428/211 |
| 4,424,245 | 1/1984 | Maruta et al. | 428/40 |
| 4,426,422 | 1/1984 | Daniels | 428/352 |
| 4,444,819 | 4/1984 | Maruta et al. | 346/209 |
| 4,513,301 | 4/1985 | Takayama et al. | 428/913 |

FOREIGN PATENT DOCUMENTS

| | | | |
|---|---|---|---|
| 2119531A | 11/1983 | United Kingdom | 346/226 |

*Primary Examiner*—Bruce H. Hess

*Attorney, Agent, or Firm*—Wilbert Hawk, Jr.; Albert L. Sessler, Jr.; George J. Muckenthaler

[57] ABSTRACT

A protective coating is applied to a thermally reactive material layer in laminate manner. The coating includes a fluorocarbon sizing agent which causes beading of any adverse material and prevents penetration thereof into the thermally reactive material. A combined color developing and dye formulation includes bisphenol, wax, clay and dye in a binder of polyvinyl alcohol which effects a spreading of any adverse material on the surface of the coating.

6 Claims, 1 Drawing Sheet

PROTECTIVE COATING FOR THERMOSENSITIVE MATERIAL

BACKGROUND OF THE INVENTION

In the field of product labeling, it has been common practice to apply the appropriate parameters such as content, weight, price and the like to the labels by means of printing apparatus utilizing ink or ink ribbons. It is further common practice to print machine readable indicia such as the bar code (now in use of the vast majority of products) on the product label by means of conventional ink printing apparatus. Meanwhile, the use of thermal printing on product labels has greatly increased in the manner of providing clear and well-defined printed characters and/or images.

The machine readable and human readable printing by use of thermal elements also has been expanded into the area of perishable goods which may be packaged in soft packages and stored in an adverse atmosphere that may affect the printing on the package. The wrapped products may include meat, poultry, fish, produce or the like which are subject to an environment containing water or water vapor (condensation) animal fat, oil, vinegar, blood, and alcohol, and it is commonly known that the printing on the labels for these products must be protected from exposure to such environmental elements to enable fast and correct reading of the printed matter.

Representative documentation in the field of protective coatings for thermosensitive type sheets includes U.S. Pat. No. 3,516,904, issued to J. J. Klinker on June 23, 1970, which discloses a heat release layer on a carrier, a primer and protective coating, a design print, and an adhesive layer.

U.S. Pat. No. 4,370,370, issued to S. Iwata et al. on Jan. 25, 1983, discloses a thermosensitive recording adhesive label having a support sheet, a coloring layer of leuco dye and acidic material on the front side of the support sheet, a front barrier layer of polymeric material, a back barrier layer of polymeric material, an adhesive layer on the back barrier layer, and a disposable backing sheet peelable from the adhesive layer.

U.S. Pat. No. 4,388,362, issued to S. Iwata et al. on June 14, 1983, discloses a heat sensitive recording paper having a substrate, a color forming layer of leuco dye and acidic material on the substrate, and a protective layer of water soluble resin. A pattern is printed on the protective layer with ultraviolet setting type ink and an adhesive layer is formed on the back of the substrate with a releasable paper on the adhesive layer.

U.S. Pat. No. 4,424,245, issued to K. Maruta et al. on Jan. 3, 1984, discloses a thermosensitive recording type label sheet having a support, a coloring layer of leuco dye and acidic material on the front side, a barrier layer of water soluble polymeric material and water repellent wax material, and an adhesive layer on the barrier layer.

U.S. Pat. No. 4,426,422, issued to G. R. E. Daniels on Jan. 17, 1984, discloses distortion and chemically resistant heat transfer materials formed by a mixture of two interspersed polymers, one being an acid based polyester and the other an ethylene vinyl acetate copolymer. The labels resist alcohols, oils, detergents, inks and adhesives.

And, U.S. Pat. No. 4,444,819, issued to K. Maruta et al. on Apr. 24, 1984, discloses thermosensitive recording material having support material, a coloring layer of leuco dye and acidic material, and a protective layer of PVA with a saponification ratio of 70 to 85%.

SUMMARY OF THE INVENTION

The present invention relates to thermally printed sheets or like material and, more particularly, to means for protecting the printed matter from exposure to elements present in an adverse environment. The printed sheets are formed in the manner of labels provided for those products normally contained in wrapped packages, and the printed matter on the labels must be protected from adverse elements or material in the surrounding atmosphere in order to maintain the printing in clear and well-defined condition to enable machine and human reading of such printed matter.

The protective coating of the present invention comprises a thermally reactive coating or layer, and a sizing agent top coat containing fluorochemical material for providing protection against intrusion of adverse material or elements into the reactive coating. The thermally reactive coating includes a formulation having a color forming dye, a wax, and a binder. In one formulation, the sizing agent is mixed into a top coat or layer consisting of a binder and an anti-stick material. This mixture is applied on top of the thermally reactive layer and provides a protection therefor in a manner wherein any adverse material or element is caused to bead on the surface of the mixture. A second formulation provides for mixing the sizing agent into a top coat or layer consisting of a binder, an anti-stick material, and a color forming dye. This mixture is applied on top of the thermally reactive material. A third formulation provides for cross linking a binder by chrome complex directly into the thermally reactive dye coating.

A preferred base coat composition consists of a color developer formulation and a dye formulation, the first formulation including a bisphenol, a wax, a clay and a binder, and the dye formulation including a binder and a black dye. Another arrangement for the protection includes a two coat system including a thermally reactive layer and a top coating having a cross linking agent in a binder solution.

In view of the above discussion, the principal object of the present invention is to provide a protective coating for thermosensitive material that is subjected to adverse environmental conditions.

Another object of the present invention is to provide protection for thermally printed images by means of a protective coating.

An additional object of the present invention is to provide a thermally reactive coating and protective material in the coating to protect thermally printed matter from elements in an adverse environment.

A further object of the present invention is to provide means including a protective layer with a thermal reactive layer for protecting the thermal reactive layer from adverse material under certain environmental conditions.

Additional advantages and features of the present invention will become apparent and fully understood from a reading of the following description taken together with the annexed drawing.

DESCRIPTION OF THE PREFERRED EMBODIMENT

Prior to discussing the several illustrations and examples disclosing the present invention, it should be noted that the protective coatings or layers are especially significant and important for use in business entities having meat and produce type environments. The labels which are placed on packaged meat or produce generally carry a company name and/or logo along with a bar code, and printed matter identifying the commodity, the unit weight, the price per unit, and the total price. The bar code and the identifying indicia are thermally printed and such thermal printing must be protected from any adverse environmental material or elements for a period of time so as to maintain a readable image of the printed matter.

Figure 1:
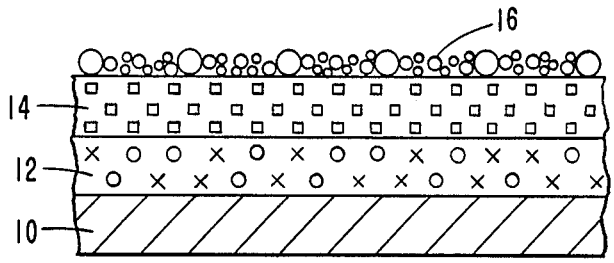
FIG. 1 is a sectional view of a thermally coated sheet incorporating one aspect of the present invention.

Referring now to the drawing, FIG. 1 illustrates a protective arrangement which comprises a base sheet 10 of paper or like material and which is preferably of quality grade coated two sides (C2S) paper. The paper 10 is weighted at a range of 32 to 55 pounds per ream based on a 24"×36" size and preferably at 45 pounds per ream and is of a quality which displays intense and well-defined black images. The base sheet 10 supports a thermally reactive coating or layer 12 consisting essentially of a color forming dye, a wax, and a binder. The color forming dye may be one selected from the group of colorless or light colored dyes. The wax may be one selected from the group of those waxes that enable fast transfer of heat in the color forming process and which remain wet or moist in a tacky condition for but a short period of time. A top coating or layer 14 includes a fluorochemical ingredient, hereinafter further described.

The following examples disclose thermal paper coating systems including means for providing protective material layers or coatings and utilizing same to prevent intrusion of adverse material into the thermally active material and prepared for use on a thermally printed label.

EXAMPLE I

Example I is a composition, arranged as in FIG. 1, and a method of providing the protection required for thermosensitive or thermally reactive material.

| Material | % Dry | Range |
|---|---|---|
| Cellulose Binder | 73.0 | 70–95 |
| Sizing Agent | 5.0 | 1–10 |
| Release Agent | 5.0 | 1–10 |
| Synthetic Wax | 15.0 | 10–20 |
| Anti-foam and Wetting Agents | 2.0 | 1–3 |
| | 100.0 | |

The fluorochemical sizing agent is mixed into the top coat or layer 14 consisting of the binder, the wax, the wetting agent and the anti-foam material, and the coating or layer is applied on top of the thermally reactive layer 12. The top coat or layer 14 containing the fluorocarbon sizing agent causes beading, illustrated as 16 in FIG. 1, of any damaging or adverse material or elements, such as oil, water, alcohol, etc., and prevents penetration of such material or elements into the thermally reactive layer 12 which, in a preferred thickness and range thereof, has a weight of 3.5 to 4.5 pounds per ream based on a 25"×38" size.

EXAMPLE II

Figure 2:
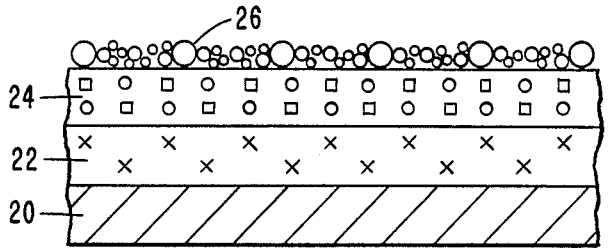
FIG. 2 is a sectional view of a base sheet having means protecting a coating on the sheet.

Another example of the use of the fluorocarbon sizing agent for providing protection for thermosensitive material is described by way of the following example and illustrated in FIG. 2.

| Material | % Dry | Range |
|---|---|---|
| Cellulose Binder | 76.0 | 60–95 |
| Sizing Agent | 5.0 | 1–10 |
| Black dye | 15.0 | 10–20 |
| Synthetic Wax | 2.0 | 1–10 |
| Anti-foam and Wetting Agents | 2.0 | 1–3 |
| | 100.0 | |

The fluorochemical sizing agent is mixed into a top coat or layer 24 consisting of the binder, the anti-foam and wetting materials, the wax, and the color-forming black dye. This mixture is applied on the surface of a reactive material layer 22 which consists of a reactive material, a wax and a binder on the top surface of a paper or like substrate 20. The fluorocarbon material in the top layer 24 causes any damaging or adverse material to bead on the surface, the beading formation being illustrated as 26 in FIG. 2, and the top layer prevents penetration of such adverse material into the thermally reactive material layer 22.

EXAMPLE III

Figure 3:
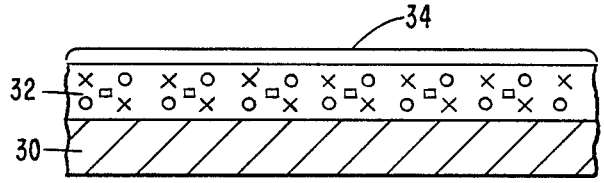
FIG. 3 is a sectional view of a base sheet having thermally reactive material thereon which material includes a protective binding material.

Example III is another composition and a method of providing protection for the thermosensitive material in a single coat arrangement, as illustrated in FIG. 3.

| COLOR DEVELOPER FORMULATION | | |
|---|---|---|
| Material | % Dry | Range |
| Bisphenol | 22.7 | 20–40 |
| Amide Wax | 20.0 | 15–25 |
| Clay | 41.1 | 35–45 |
| Polyvinyl Alcohol Binder | 15.0 | 10–20 |
| Anti-foam and Wetting Agents | 1.1 | 1–3 |
| | 99.9 | |

Water is added to the formulation for dilution as necessary depending upon the coating technique.

| DYE FORMULATION | | |
|---|---|---|
| Material | % Dry | Range |
| Polyvinyl Alcohol Binder | 10.0 | 8–15 |
| Anti-foam and Wetting Agents | 0.3 | 0.2–1.0 |
| Black dye | 89.7 | 85–92 |
| | 100.0 | |

Water is added to the formulation for dilution as necessary depending upon the coating technique.

A preferred base coat composition, for protecting against adverse material or elements in certain environments, consists of the above formulations each of which are mixed and dispersed by means of an attritor or like dispersion apparatus. The formulated mixtures are then mixed together with a Quilon solution prior to coating on the paper 30. The Quilon "S" solution is mixed in an equal amount on a 1 to 1 ratio based on the total polyvinyl alcohol (PVA) solids.

The combined formulations of color developer and dye including the Quilon "S" solution are mixed directly into the thermally reactive coating 32 and this overall mixture is coated on a base sheet 30. The combined formulated coating 32 material allows any adverse material to spread on the surface in a thin film-like condition, as illustrated at 34 in FIG. 3, but prevents entry of such adverse material into the thermally reactive material of the coating.

The single coating 32 utilizes the effective crosslinking of the polyvinyl alcohol binder by the Quilon chrome complex in isopropanol (approximately a 30% solution of stearato chromic chloride) to provide or render a thermally active dye coating that has good to excellent protection against oil, lard, water and/or alcohol solutions and allows such adverse materials to spread in a film-like condition, illustrated as 34 on the surface of coating 32. The addition of the Quilon solution to the base coating formulation causes a light green surface color on the finished thermal paper.

EXAMPLE IV

Another two coat system for protecting thermal activated reactants from adverse materials is described as follows and illustrated in FIG. 4.

A paper or like substrate 40 has coated thereon a base layer or coat 42 with a protective top coat 44 on the base coat. The base coat 42 composition is made up of the color developing formulation and the dye formulation of Example III, and Glyoxal (OHCCHO) is the cross linking agent for the polyvinyl alcohol binder incorporated into both the thermally reactive base coat 42 and into the top coat 44. The amount of Glyoxal is in the range of 5 to 12 percent and preferably is 10 percent based on the total solids in the base coat 42.

The top coat 44 consists of the polyvinyl alcohol binder, Glyoxal in a range of 5 to 15 percent and preferably 10 percent based on the PVA solids, a wetting agent, and water for dilution as necessary. The two coat system provides good protection to thermal printed matter from oil, lard, water and aqueous alcohol solutions, and sustains any such adverse matter in the spread or film-like condition, illustrated as 46 on the surface of the top coat 44.

EXAMPLE V

Figure 4:
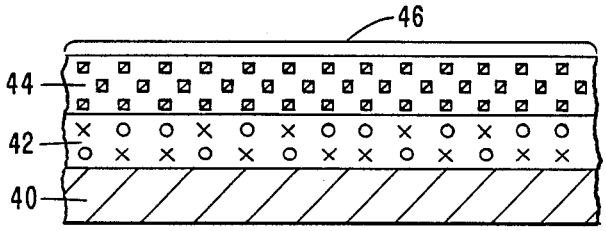
FIG. 4 is a sectional view of a base sheet having a reactive layer and a protective coating.

This example is similar to Example IV in utilizing Glyoxal as a cross linking agent for the polyvinyl alcohol binder incorporated into the thermal reactive base coat 42 and into the top coat 44, as seen in FIG. 4.

The formulation for the top coating 44 includes oxidized starch as a substitute for the polyvinyl alcohol binder, Glyoxal in a range of 5 to 15 percent and preferably 10 percent based on the oxidized starch solids, a wetting agent, and water for dilution as necessary.

EXAMPLE VI

Figure 5:
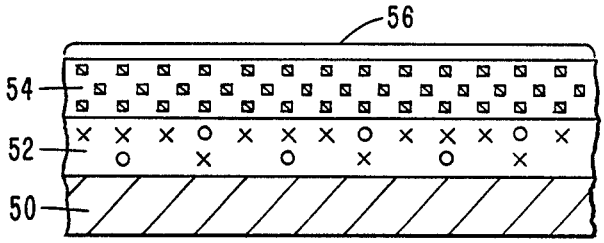
FIG. 5 is a sectional view of a modified arrangement from FIG. 4.

A further example includes the use of Casein in the top coating 54 (FIG. 5) along with a wetting agent and water for dilution. The base coating 52 on the paper or like substrate 50 is the same as described for Example III, except for the combined materials therein. The Casein material provides good to excellent protection to thermal developed printing or images from the presence of oil, lard, water and alcohol solution, which materials appear as and form a spread or film-like condition, illustrated as 56 in FIG. 5.

The various ingredients utilized in the above examples are hereafter further identified and are available from the noted sources. The cellulose binder is CMC-7 carboxymethyl cellulose from Hercules Inc., the sizing agent is FC-807 fluorochemical from 3M Company, and the black dye is Pergascript I-2R from Ciba-Geigy Corporation. One wax as listed is Acrawax C formulated as a synthetic wax and available from Glyco Inc.

The bisphenol A is defined as 4, 4 isopropylidenediphenol, the amide wax is Armid HT from Armour Chemical Company, Engelhard Corporation manufactures the Ansilex clay, and Air Products Corporation provides the polyvinyl alcohol binder. The anti-foam and wetting agents used in the above Examples are Nopco NDW from Diamond Shamrock Corp., Zonyl FSO from E. I. du Pont de Nemours and Company, Niaproof 08, further identified as Sodium-2-Ethylhexyl Sulfate, from Niacet Corporation, and Calgon is hexametaphosphate from Calgon Corporation. Quilon "S" is octadecanotao chromic chloride hydroxide from du Pont, Glyoxal (OHCCHO) from Aldrich Chemical Company, Stayco G starch is available from A. E. Staley Company, and Casein is made by National Casein.

A testing operation was set up to test surface resistance of the protected thermosensitive coatings to oil, lard, water and aqueous alcohol. The testing procedure and equipment included the use of a heat gradient step wedge instrument (Precision Gage & Tool Co.) to develop black color on the surfaces of the thermosensitive coatings at seven different temperatures ranging from 200 degrees F. to 310 degrees F., and a DNL-2 opacimeter (Technidyne Corporation) to read light reflectance from the surfaces of the test areas.

Test sample preparation for oil and lard testing included the developing of black color areas by using the step wedge instrument and then spreading a 3 to 10 micron layer of oil and lard across all seven developed black areas. The test samples were then allowed to stand at laboratory ambient temperature for one, two, and four hour testing periods. After such test periods, the samples were wiped clean with an absorbent paper towel and the light reflectance of each test surface was measured with the DNL-2 opacimeter.

For the water and 20% aqueous ethanol testing, the black color areas which were developed at 260 degrees F. and 280 degrees F. were subjected to two inch square absorbent paper pads soaked with the water or the 20% aqueous ethanol and weighted with a 100 gram weight across the paper pad to assure intimate contact between the soaked pads and the test surfaces. After standing for one hour at laboratory ambient temperature, the soaked pads were removed, the wet paper was allowed to dry, and the test surface light reflectance was measured with the opacimeter.

The test samples included Examples III, IV, V, and VI and a control sample which comprised a coating of the thermally reactive materials without topcoating or binder cross linking agents. It was found that whenever oil, lard, water, or an aqueous alcohol solution penetrated the protected coatings, the black, heat developed color was destroyed and the color returned to white. The reflectance readings obtained from the opacimeter were low readings when the black areas were read, solid black approaching 0 percent reflectance, and the readings were high readings as the color turns to white, a solid white color approaching 100 percent reflectance.

The test data is presented in Tables 1 to 4. Table 1 presents readings taken for resistance to oil with a control sample and with the protective coating as set out in above Examples III, IV, V and VI. Table 2 presents readings taken for resistance to lard with samples from above Examples III, IV, V and VI.

Table 3 illustrates test results for water resistance at two temperatures and at an initial time and at one hour later, and Table 4 shows the results for 20 percent aqueous ethanol resistance.

TABLE 1

| IMAGE DEV. | CONTROL 13538-67B | | | | EXAMPLE 3 13539-14B | | | | OIL RESISTANCE (Planters Oil) EXAMPLE 4 13539-22C | | | | EXAMPLE 5 13539-22D | | | | EXAMPLE 6 13539-28 | | | |
|---|---|---|---|---|---|---|---|---|---|---|---|---|---|---|---|---|---|---|---|---|
| TEMP. | 0 | 1 hr. | 2 hr. | 4 hr. | 0 | 1 hr. | 2 hr. | 4 hr. | 0 | 1 hr. | 2 hr. | 4 hr. | 0 | 1 hr. | 2 hr. | 4 hr. | 0 | 1 hr. | 2 hr. | 4 hr. |
| 200° F. | 9.4 | 78.2 | 82.8 | 65.9 | 10.3 | 42.2 | 37.9 | 43.4 | 13.0 | 12.4 | 12.8 | 14.5 | 11.5 | 11.7 | 12.4 | 14.9 | | | | |
| 220° F. | 5.6 | 64.4 | 74.5 | 60.2 | 7.5 | 29.3 | 26.8 | 33.1 | 9.2 | 8.6 | 8.2 | 8.7 | 8.2 | 9.7 | 10.5 | 11.7 | | | | |
| 230° F. | 6.3 | 66.6 | 77.0 | 61.0 | 6.2 | 19.4 | 21.4 | 26.1 | 8.9 | 8.3 | 8.9 | 10.0 | 7.8 | 12.7 | 12.8 | 15.4 | 7.7 | 8.2 | 11.4 | 20.4 |
| 240° F. | 5.7 | 64.3 | 73.0 | 61.5 | 5.3 | 17.5 | 19.0 | 21.7 | 7.6 | 7.4 | 8.3 | 9.3 | 7.5 | 16.1 | 15.2 | 19.4 | 6.6 | 8.1 | 10.3 | 18.4 |
| 260° F. | 5.4 | 59.7 | 74.9 | 58.3 | 5.1 | 13.0 | 14.0 | 16.5 | 6.9 | 6.8 | 7.5 | 8.4 | 6.9 | 17.9 | 17.4 | 25.4 | 6.5 | 7.3 | 10.3 | 12.8 |
| 280° F. | 5.1 | 57.2 | 69.3 | 60.8 | 4.7 | 12.2 | 10.9 | 12.4 | 6.2 | 6.0 | 6.6 | 7.1 | 6.3 | 14.9 | 19.5 | 25.4 | 6.1 | 7.0 | 9.5 | 10.6 |
| 310° F. | 4.9 | 49.3 | 52.9 | 46.7 | 4.5 | 9.7 | 9.1 | 10.4 | 6.2 | 5.8 | 6.3 | 6.3 | 5.7 | 14.0 | 11.1 | 13.8 | 6.2 | 10.0 | 11.6 | 16.4 |

TABLE 2

| IMAGE DEV. | CONTROL 13538-67B | | | | EXAMPLE 3 13539-14B | | | | LARD RESISTANCE (Bob Evans Lard) EXAMPLE 4 13539-22C | | | | EXAMPLE 5 13539-22D | | | | EXAMPLE 6 13539-28 | | | |
|---|---|---|---|---|---|---|---|---|---|---|---|---|---|---|---|---|---|---|---|---|
| TEMP. | 0 | 1 hr. | 2 hr. | 4 hr. | 0 | 1 hr. | 2 hr. | 4 hr. | 0 | 1 hr. | 2 hr. | 4 hr. | 0 | 1 hr. | 2 hr. | 4 hr. | 0 | 1 hr. | 2 hr. | 4 hr. |
| 200° F. | 9.4 | 62.6 | 70.8 | 70.8 | 10.3 | 29.8 | 24.5 | 24.0 | 13.0 | 13.6 | 12.2 | 14.4 | 11.5 | 11.7 | 12.6 | 13.8 | | | | |
| 220° F. | 5.6 | 41.6 | 60.0 | 57.3 | 7.5 | 20.1 | 17.5 | 14.2 | 9.2 | 9.9 | 7.6 | 8.3 | 8.2 | 9.8 | 11.4 | 12.2 | | | | |
| 230° F. | 6.3 | 50.1 | 64.7 | 60.8 | 6.2 | 16.0 | 13.8 | 10.7 | 8.9 | 9.1 | 8.5 | 9.8 | 7.8 | 11.3 | 13.6 | 17.7 | 7.7 | 7.4 | 8.6 | 10.9 |
| 240° F. | 5.7 | 60.4 | 63.5 | 62.9 | 5.3 | 10.8 | 11.6 | 9.8 | 7.6 | 8.1 | 7.7 | 8.8 | 7.5 | 12.8 | 13.7 | 16.4 | 6.6 | 7.2 | 8.4 | 9.2 |
| 260° F. | 5.4 | 37.8 | 63.8 | 52.7 | 5.1 | 9.8 | 9.9 | 8.8 | 6.9 | 7.3 | 7.1 | 7.7 | 6.9 | 13.0 | 13.8 | 21.1 | 6.5 | 6.7 | 7.8 | 9.3 |
| 280° F. | 5.1 | 29.1 | 43.3 | 41.4 | 4.7 | 7.6 | 8.2 | 8.1 | 6.2 | 6.4 | 6.4 | 6.8 | 6.3 | 10.8 | 10.4 | 19.2 | 6.1 | 6.5 | 8.1 | 9.3 |
| 310° F. | 4.9 | 19.5 | 25.8 | 36.8 | 4.5 | 6.6 | 7.8 | 7.2 | 6.2 | 6.4 | 6.3 | 6.4 | 5.7 | 10.0 | 8.1 | 14.2 | 6.2 | 6.9 | 8.4 | 11.4 |

TABLE 3

| IMAGE DEV. | 13538-67B CONTROL | | EXAMPLE 3 13538-67B | | WATER RESISTANCE EXAMPLE 4 13539-22C | | EXAMPLE 5 13539-22D | | EXAMPLE 6 13539-28 | |
|---|---|---|---|---|---|---|---|---|---|---|
| TEMP. | 0 | 1 HR. | 0 | 1 HR. | 0 | 1 HR. | 0 | 1 HR. | 0 | 1 HR. |
| 260° F. | 5.2 | 9.4 | 4.4 | 5.7 | 7.0 | 9.1 | 6.5 | 8.0 | 6.8 | 9.4 |
| 280° F. | 4.8 | 6.3 | 4.3 | 5.0 | 6.3 | 7.7 | 5.9 | 7.1 | 6.3 | 8.3 |

TABLE 4

| IMAGE DEV. | 13538-67B CONTROL | | EXAMPLE 3 13539-14B | | 20% AQUEOUS ETHANOL RESISTANCE EXAMPLE 4 13539-22C | | EXAMPLE 5 13539-22D | | EXAMPLE 6 13539-28 | |
|---|---|---|---|---|---|---|---|---|---|---|
| TEMP. | 0 | 1 HR. | 0 | 1 HR. | 0 | 1 HR. | 0 | 1 HR. | 0 | 1 HR. |
| 260° F. | 5.2 | 21.4 | 4.6 | 11.3 | 6.8 | 16.9 | 6.2 | 15.9 | 6.3 | 29.9 |
| 280° F. | 4.9 | 18.6 | 4.3 | 10.6 | 6.2 | 14.3 | 5.7 | 12.4 | 6.7 | 22.5 |

An analysis of the data presented in Tables 1 to 4 demonstrates the protective nature of the composition or formulation described in Examples III, IV, V, and VI when compared with their respective control samples (non-protected coatings). For example, in Table 1, it is seen that the control sample changed appreciably in reflectance after being in contact with oil after one hour of time, 4.9% reflectance (very black) to 49.3% reflectance (light gray) at 310 degrees F. color development temperature. Contrasting with such test result is the reflectance value of Example IV in Table 1 which shows practically no change after being in contact with oil for 4 hours, 6.2% to 6.3% reflectance. The test data in Tables 1 and 2 demonstrates that all four Examples, III to VI, provide appreciable protection from oil and lard contact.

The test data in Tables 3 and 4 show the % reflectance difference between time 0 and at 1 hour thereafter when subjected to water and 20% aqueous ethanol contact. The difference between time 0 and at 1 hour of the control samples is compared to the same time interval of Examples III to VI.

It is discovered that the step wedge heat developed black color areas vary in depth of blackness with the development temperature, and it is seen that the black area developed at 310 degrees F. was much darker than the black area developed at 200 degrees F. The data collected at 260, 280, and 310 degrees F. development temperatures are most significant since they more closely represent thermal printing temperatures.

It is thus seen that herein shown and described is a thermal sensitive sheet having means thereon for protecting printed characters or images. The arrangement enables the accomplishment of the objects and advantages mentioned above, and while a preferred embodiment of the invention has been disclosed herein, variations thereof may occur to those skilled in the art. It is comtemplated that all such variations not departing from the spirit and scope of the invention hereof are to be construed in accordance with the following claims.

What is claimed is:

1. A protective coating for use on thermally reactive material, said coating comprising a color developer formulation essentially consisting of about 20–40% bisphenol, about 15–25% amide wax, about 35–45% clay, and about 10–20% polyvinyl alcohol, and a dye formulation essentially consisting of about 85–92% color forming dye, and about 8–15% polyvinyl alcohol, and a cross linking agent of about 10–15% octadecanotao chromic chloride hydroxide incorporated into the polyvinyl alcohol of the combined formulations, said protective coating being applied to said thermally reactive material to prevent penetration of adverse environmental matter into said material.

2. A protective coating for use on thermally reactive material, said coating comprising a color developer formulation essentially consisting of about 20–40% bisphenol, about 15–25% amide wax, and about 35–45% clay in a binder of about 10–20% polyvinyl alcohol, and a dye formulation essentially consisting of about 85–92% color forming dye in a binder of about 8–15% polyvinyl alcohol, and a crosslinking agent of about 10–20% of a 30% solution of stearato chromic chloride, said protective coating being applied to said thermally reactive material to prevent intrusion of adverse matter into said material.

3. A protective coating for use on thermosensitive material, said coating comprising a color developer formulation essentially consisting of a bisphenol, a wax and a clay in a binder of polyvinyl alcohol, and a dye formulation essentially consisting of a color forming dye in polyvinyl alcohol and dispersed in the color developer formulation, and a cross linking agent of chromic chloride in about an equal amount as and incorporated into the total polyvinyl alcohol of the combined formulations, said protective coating being adaptable to be applied to said thermosensitive material to prevent penetration of adverse environmental matter into said material.

4. The protective coating of claim 3 wherein oxidized starch is substituted for polyvinyl alcohol as a binder material.

5. The protective coating of claim 3 wherein the color developer formulation and the dye formulation are mixed together with the cross linking agent comprising a solution of chrome complex in isopropanol and which solution is incorporated into the formulations in an amount on a 1 to 1 ratio based on the combined polyvinyl alcohol.

6. The protective coating of claim 3 including a sheet for supporting the combined color developer and dye formulations.

* * * * *